United States Patent [19]

Raasoch

[11] Patent Number: 4,546,971

[45] Date of Patent: Oct. 15, 1985

[54] EXERCISE DEVICE

[76] Inventor: Paul Raasoch, Rte. 2, Box 124A, Fort Atkinson, Wis. 53538

[21] Appl. No.: 647,712

[22] Filed: Sep. 5, 1984

[51] Int. Cl.[4] ..... A63B 21/06

[52] U.S. Cl. ..... 272/118; 272/117; 272/134

[58] Field of Search ..... 272/117, 118, 134, 93

[56] References Cited

U.S. PATENT DOCUMENTS

| | | | |
|---|---|---|---|
| 3,858,873 | 1/1975 | Jones . | |
| 3,905,599 | 9/1975 | Mazman . | |
| 3,998,454 | 12/1976 | Jones . | |
| 4,063,726 | 12/1977 | Wilson . | |
| 4,257,593 | 3/1981 | Keiser . | |
| 4,317,566 | 3/1982 | Uyeda et al. . | |
| 4,339,125 | 7/1982 | Uyeda et al. . | |
| 4,353,547 | 10/1982 | Jenkinson . | |
| 4,354,676 | 10/1982 | Ariel . | |
| 4,397,462 | 8/1983 | Wilmarth . | |
| 4,478,411 | 10/1984 | Baldwin | 272/118 |

FOREIGN PATENT DOCUMENTS

| | | | |
|---|---|---|---|
| 0635999 | 12/1978 | U.S.S.R. | 272/117 |

*Primary Examiner*—Richard J. Apley
*Assistant Examiner*—Robert W. Bahr
*Attorney, Agent, or Firm*—Isaksen, Lathrop, Esch, Hart & Clark

[57] ABSTRACT

An exercise device for the exercise of a user's muscles by movement through an exercise stroke. The exercise device includes a weight tower frame and concentric and eccentric weight stacks, each having a selected number of weights stacked in a generally vertical array, the weights being movable between lowered and elevated positions. The exercise device further includes selected levers and mechanical linkages designed to respond to force applied by the exercise of the user's muscles by the lifting of selected weights of the concentric weight stack from the lowered to the elevated position. A pneumatic cylinder and related linkages lift from the lowered to the elevated position a selected number of the weights of the eccentric weight stack without additional exertion of the user and, at a selected point in the exercise stroke, are caused to add automatically the weight of the weights so lifted to that of weights of the concentric weight stack lifted by the user.

9 Claims, 5 Drawing Figures

EXERCISE DEVICE

TECHNICAL FIELD

The present invention relates to exercise devices in general, and, in particular, to such devices in which the amount of weight lifted by a user can be varied.

BACKGROUND OF ART

The use of machines to provide a controlled resistance to bodily muscle function for the purpose of exercising and training is well known. In part, such machines are adapted to simulate barbells and other such weights traditionally used for weight lifting exercise. The machines disclosed in Uyada, et al., U.S. Pat. No. 4,317,566; Uyada, et al., U.S. Pat. No. 4,339,125; and Mezman, U.S. Pat. No. 3,905,599, are typical. The machines shown in these patents employ levers moved by the person exercising in such a way that weights are lifted. The weights involved are arranged in a stack of flat, brick-like weights. Movement of the lever by the person exercising causes a vertically oriented bar to move upwardly. A selected number of weights may be engaged with the bar so as to be lifted by the user by thrusting a pin through a hole in the weight and on through a corresponding hole in the vertical bar. This arrangement for attaching weights is common. When the user of the machine wishes to change the amount of weight that is being lifted, the user typically must pause to change the location of the pin to engage more or fewer weights. The user of an exercise machine typically places himself at a particular location with respect to the machine, hereinafter referred to as the "exercise station," where he sits, stands, or lies so oriented as to operate the levers or comparable devices that must be moved to exercise. The exercise station is usually remote from the stack of weights.

In certain exercising routines, it is considered desirable to lift a series of weights in direct succession, each weight being slightly heavier than that preceding it. This procedure is called "pyramiding." Pyramiding cannot be smoothly and easily carried out on an exercise machine when the user must pause between each effort, leave the exercise station, and go to a different location relative to the machine to change the amount of weight being lifted. Consequently, with machines such as those shown in the cited patents, a second person typically must be stationed beside the weights to tend them. In addition to the disadvantage of requiring a second person, the procedure outlined also places that second person near moving parts of the machinery where cables, levers, and dropping weights can present hazards to health.

Pneumatic and hydraulic cylinders have been employed in exercising machines. Thus, hydraulic or pneumatic cylinders have been used to provide a force against which the exerciser must exert himself, the hydraulic or pneumatic cylinders being effectively substituted for the stack of weights used in the machines discussed above. Examples include Jenkinson, U.S. Pat. No. 4,353,547; Wilmarth, U.S. Pat. No. 4,397,462; Keiser, U.S. Pat. No. 4,257,593; Ariel, U.S. Pat. No. 4,354,676; and Wilson, U.S. Pat. No. 4,063,726. Instead of engaging or disengaging weights to be lifted, pressure in the hydraulic or pneumatic cylinder is changed to increase or decrease the resistance provided by the machine to a user's exertions.

Exercise machines tend to operate cyclically. A weight is lifted and then returned to its original position, a spring is compressed and rebounds, the air in a cylinder is compressed and allowed to expand, and so forth. Such a cycle shall be referred to herein as a "stroke" in the use of an exercise machine. In certain therapy and training regimens, it is considered beneficial to vary the resistance being offered by the machine to the user's efforts within various parts of the stroke. In other instances, resistance is adjusted to vary in proportion to the force being applied by the user, the speed of movement, the acceleration, and so forth. The machines disclosed in Ariel and Wilson vary hydraulic pressure or the like under electronic control to achieve the desired pattern of resistance. Jones, U.S. Pat. No. 3,998,454; and Jones, U.S. Pat. No. 3,858,873 disclose noncircular cams that turn and take up cables or chains that in turn are connected to weights. As a consequence of this structure, force is applied by the cable or chain to the cam with varying moment arms. Thus, cams can be designed to cause the resistance experienced by one attempting to turn the cams to vary in a predetermined pattern.

When a weight is lifted and then returned to the floor, the weight lifter must first contract muscles in the manner necessary to lift the weight and then must relax the muscles in a controlled way to lower the weight again without dropping it. A stroke on an exercising machine also typically involves a first part, during which muscles are being contracted until a maximum degree of contraction is reached, and a second part, in which the muscles are relaxed in a controlled manner, which exerts continued resistance to the force being overcome, as the user's limbs are returned to the beginning position and the stroke is completed. The first part will sometimes be referred to herein as the "contraction portion" of a stroke, and the second part as the "relaxation portion."

In many instances, an exerciser is capable of utilizing more weight or withstanding a greater force in the relaxation portion of a stroke then in the contraction portion. Furthermore, in certain exercising, therapeutic, and training regimens, it is considered especially beneficial to increase the weight or force against which the muscles of the exerciser must act in the relaxation portion as opposed to the contraction portion of the stroke. By this means, the muscles can be exercised to the maximum throughout the stroke. As a consequence, the same amount of therapeutic or training effect may be achieved in less time or fewer strokes than would be necessary if the weight or force to be resisted is held constant throughout the stroke. Weight or force held constant throughout a stroke may be referred to as "concentric" weight or force. Weight or force added primarily for the relaxation portion of a stroke may be referred to as "eccentric" weight or force.

It is known to add eccentric weight in weight training when barbells or the like are being used. The weight lifter lifts the barbells in a contraction portion of a stroke and, while the barbells are being held by the weight lifter, additional, eccentric weight is added to them by assistants. The weight lifter then lowers the barbells, now loaded with eccentric weight, in the relaxation portion of the stroke. With the barbells returned to the floor, the eccentric weight is manually removed, and the stroke may be repeated.

Conventional weight lifting and exercise machines are not well adapted for the addition of eccentric weight in the middle of a stroke. Thus, the weights used in the exercising machines shown in the two Uyada, et al. patents and in the Mezman patents can be engaged or disengaged only prior to the initiation of a stroke. The weights cannot be added during a stroke. The pneumatic exerciser shown in Ariel does provide for programming to maintain a constant force, velocity, or acceleration throughout a stroke or to vary any of these factors. However, the art is not cognizant of machine utilizing weights in which eccentric weight may be used in conjunction with concentric weights in varying the force to be overcome by the exerciser using the machine.

SUMMARY OF THE INVENTION

The present invention is summarized in that an exercising device for the exercise of a user's muscles by movement through an exercise stroke includes a weight tower frame and concentric and eccentric weight stacks supported thereby, each of the weight stacks having a selected number of weights stacked in a generally vertical array, the weights being movable between lowered and elevated positions. The exercise device further includes force responsive means for responding to force applied by the exercise of the user's muscles by the lifting of selected weights of the concentric weight stack from the lowered to the elevated position. Weight adding means lift from the lowered to the elevated position a selected number of the weights of the eccentric weight stack without substantial exertion of the user and, at a selected point in the stroke, automatically add the weight of the weights so lifted to that of weights of the concentric weight stack lifted by the user.

A primary object of the invention is to provide an exercise device in which a user exercises a bodily muscle function by exertion in lifting weights.

A second object of the invention is to provide such an exercise device in which a user may select amounts of concentric weight against which to exert his muscles and also select amounts of eccentric weight to be added to the concentric weight at a selected point in an exercise stroke.

Another object of the invention is to provide such an exercise device in which the amounts of concentric and eccentric weight to be used in a particular stroke can be selected by the exerciser without the need to leave the exercise station.

An additional object of the invention is to provide such a machine directly incorporating no electrical motors, switches, or the like, to achieve simplicity, safety, and economy of manufacture.

Another object of the invention is to provide such a machine that does not require access for its normal use to the side or back parts of the machine to reduce the amount of floor space necessary to the use of the machine.

Yet another object of the invention is to provide an exercise machine utilizing a stack of weights any number of which may be engaged so as to be lifted by the efforts of an exerciser and in which the number of weights to be lifted may be selected from a location remote from the weights themselves to safely separate the person selecting the number of weights to be lifted from the greater portion of the moving parts of the exercise device.

A further object of the invention is to provide such an exercise device that can be adapted for use to exercise any of a number of different limbs or muscles of the human body.

Other objects, features, and advantages of the invention will be apparent from the following detailed description taken in conjunction with the accompanying drawings showing a preferred embodiment of an exercise device exemplifying the principles of the invention.

DETAILED DESCRIPTION OF THE PREFERRED EMBODIMENT

Figure 1:
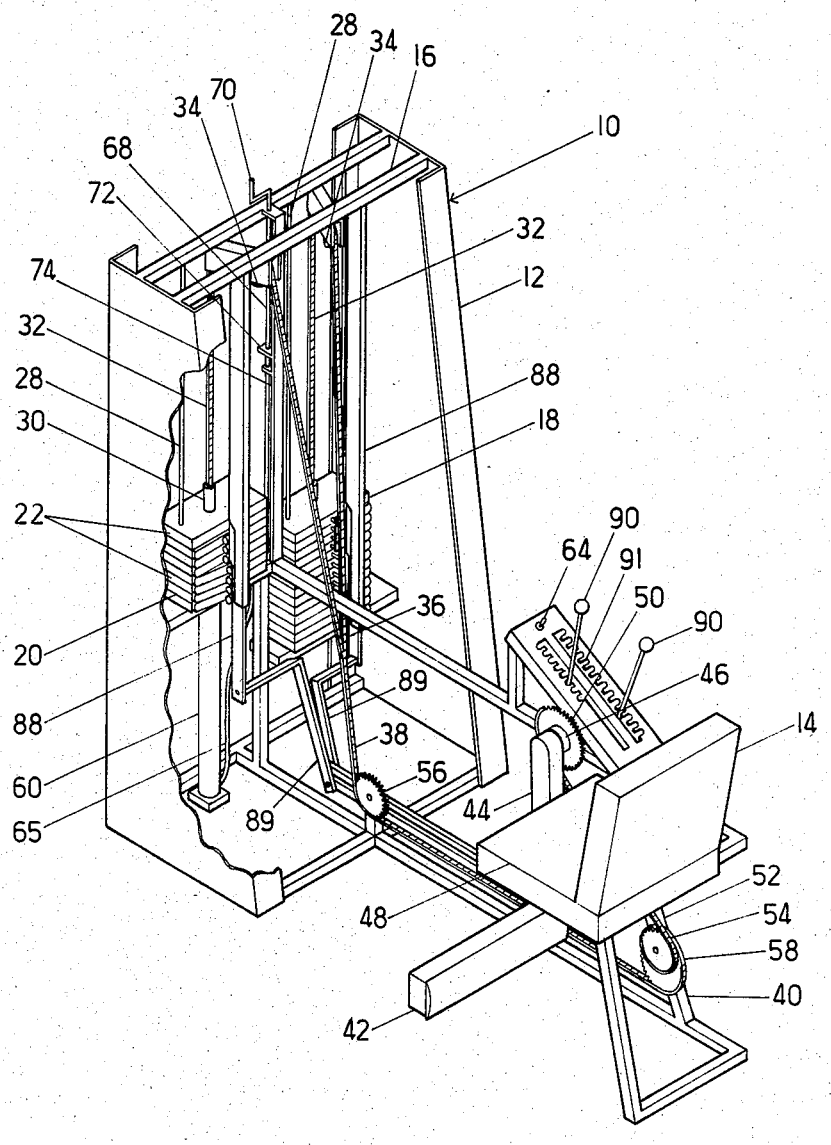
FIG. 1 is a perspective view of an exercise device constructed in accord with the present invention with a portion of the weight tower frame broken away.
Figure 2:
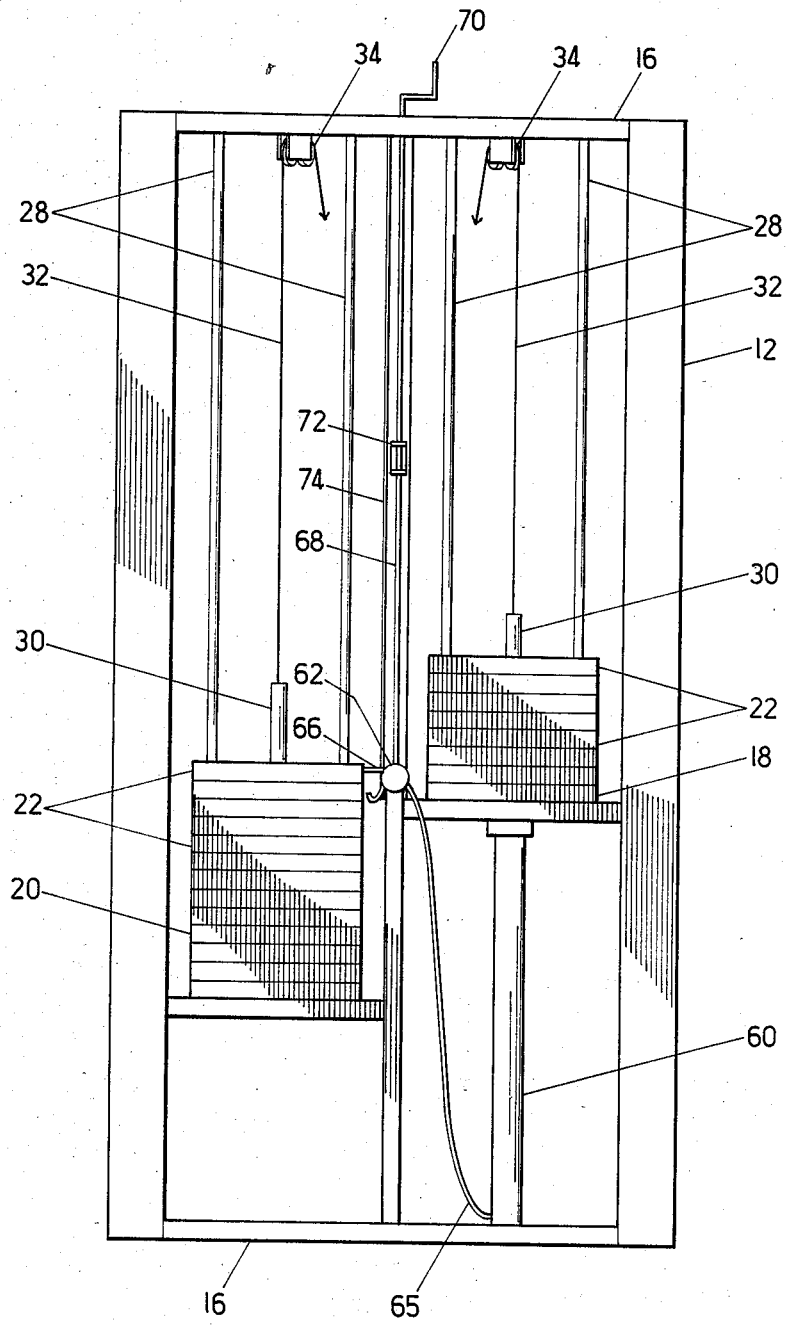
FIG. 2 is a schematic rear elevation view of the concentric and eccentric weight stacks and associated machinery of the exercise device of FIG. 1.
Figure 3:
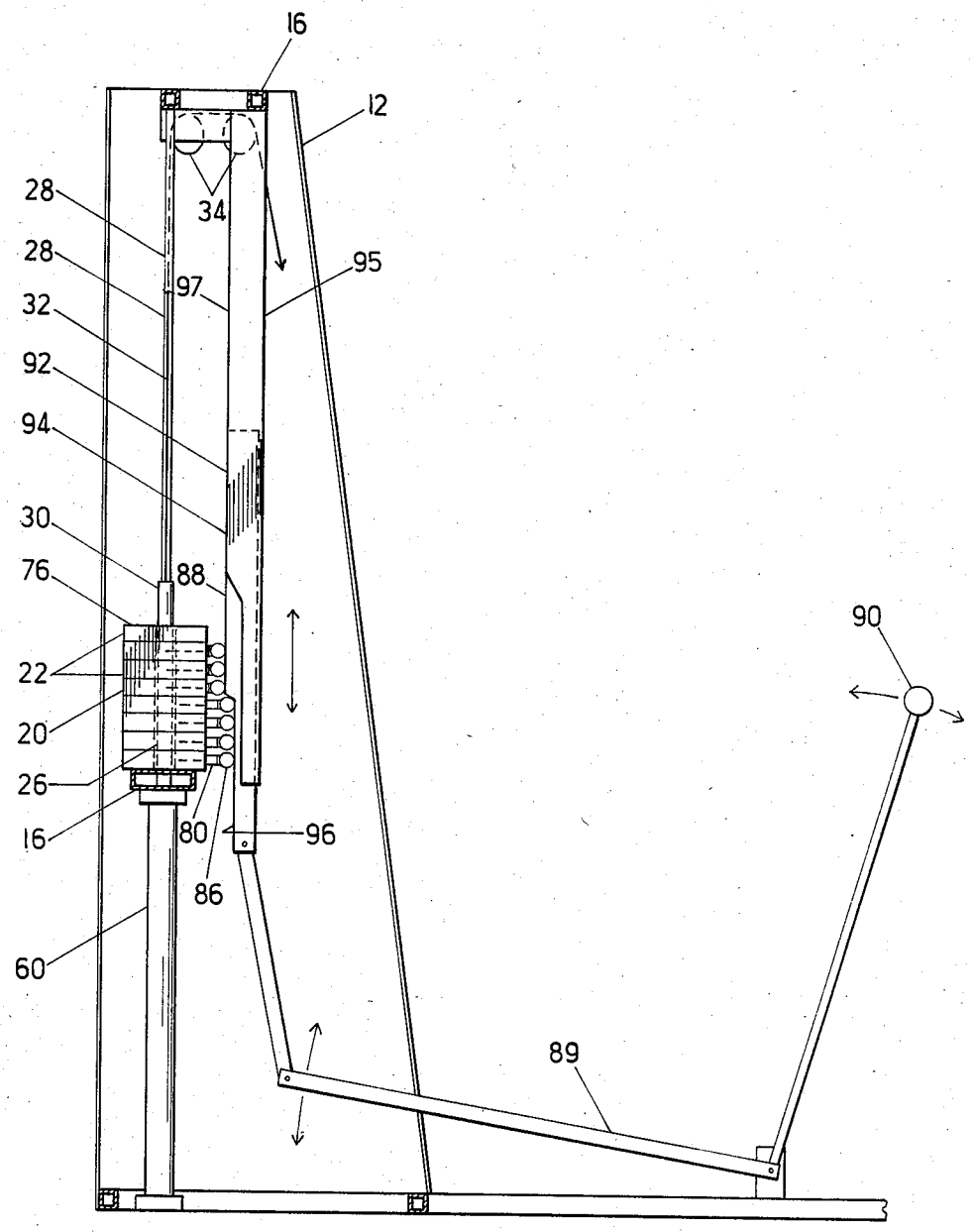
FIG. 3 is a schematic side elevation view of selected parts of the exercise device of FIG. 1 showing the remote weight selection mechanism as associated with the eccentric weight stack.

Referring more particularly to the drawings, wherein like numbers refer to like parts, FIG. 1 shows an exercise device, generally indicated at 10, constructed in accord with the present invention. The exercise device 10 includes a weight tower 12 and an exercise station 14. The weight tower 12 has a weight tower frame 16, a concentric weight stack 18 and an eccentric weight stack 20. Each weight stack 18, 20 includes a plurality of oblong weights 22. The weights 22 are generally plate-like masses of metal or other heavy material and are placed one on top of each other to form the vertically extended weight stacks 18, 20. Each oblong weight 22 has two guide holes 24, preferably separated from each other by a substantial portion of the length of the weight, and a lift rod hole 26 preferably located at approximately the center of gravity of the weight.

The weight tower 12 further has associated with each weight stack 18, 20 a pair of parallel, vertically extending guide rods 28. The guide holes 24 of the weights 22 are all in corresponding locations on successive weights 22 in the weight stacks 18, 20. Consequently, when the weights 22 are arranged in a weight stack 18, 20, the guide holes 24 are aligned vertically from the top to the bottom of the stack. A guide rod 28 passes upwardly through each such set of corresponding guide holes 24 and is then securely fastened at the top and bottom of the guide rod to the weight tower frame 16 of the weight tower 12. By this means, the weights 22 may freely slide up and down the guide rods 28 extending through their guide holes 24 without any rotational misalignment with the other weights in the weight stack 18, 20. The weights 22 of each weight stack 18, 20 may thus move between lowered and elevated positions.

The lift rod holes 26 are also aligned vertically within the weights 22 of each weight stack 18, 20. A lift rod 30 is adapted to extend from above each weight stack 18, 20 downwardly through the aligned lift rod holes 26. Releasable attachment means for releasably attaching the weights 22 to the lift rod 30 are provided and are adapted to allow a user to releasably attach a selected number of weights 22 to the lift rod 30. The preferred structure of the releasable attachment means will be discussed in greater detail, below.

A stack chain 32 is attached to each lift rod 30. At least one pulley 34 is attached to the weight tower frame 16 at a point generally above each weight stack 18, 20. The stack chain 32 associated with each weight stack 18, 20 extends upwardly, over the pulley 34 associated with the weight stack, and downwardly to a location at that side of the weight tower 12 that faces the exercise station 14. The two stack chains 32 are attached to each other by a coupling 36. A single draw chain 38 is attached to the coupling 36 and extends downwardly therefrom. It will be appreciated that a downward motion of the draw chain 38 will tend to so pull each stack chain 32 that the lift rod 30 attached thereto will tend to be lifted, along with any weights 22 attached to the lift rod.

The exercise station 14 is attached to the weight tower 12. The exercise station 14 has an exercise station frame 40. Preferably the exercise station frame 40 and weight tower frame 16 are rigidly attached to each other.

The exercise station includes a force responsive means for responding to force applied by the exercise of a user's muscles. The exact form of the force responsive means is selected to be such that the force responsive means is adapted to move as the user of the exercise device flexes the muscles to be exercised. The embodiment of the invention shown in FIG. 1 is adapted to exercise those muscles used in extending the legs. The force responsive means shown includes an ankle bar 42 attached to an ankle bar frame 44 to which in turn is attached an axle 46 rotatably mounted on the exercise station frame 40. The axle 46 and ankle bar 42 are parallel to each other and separated on the ankle bar frame 44 by a selected distance. A seat 48 is provided and rigidly attached to the exercise station frame 40 at such a point that a user of the exercising device 10 seated therein may conveniently hook his ankles under the ankle bar 42 when his legs are in a flexed position.

As the legs are extended, the user's ankles push forwardly and upwardly against the ankle bar 42, causing the ankle bar, ankle bar frame 44, and axle 46 to rotate. A first sprocketed wheel 50 is attached coaxially to the axle 46 and turns with it. A drive chain 52 is engaged with the sprockets of the first sprocket wheel 50 so as to be wound thereon as it turns. A second sprocketed wheel 54 is rotatably mounted on the exercise station frame 40, preferably at a position conveniently low on that frame. A portion of the drive chain 52 remote from the first sprocketed wheel 50 is so engaged with the sprockets of the second sprocketed wheel 54 that, as the drive chain is wound onto the first sprocketed wheel, the second sprocketed wheel is turned.

The draw chain 38 disclosed above in association with the weight tower 12 is directed downwardly from the point at which it is coupled with the two stack chains 32. A draw chain pulley 56 is rotatably mounted on the weight tower frame 16 at a point conveniently near the bottom thereof, and the draw chain 38 is passed under the draw chain pulley and directed toward the second sprocketed wheel 54. Preferably an eccentric cam 58 is attached rigidly to the second sprocketed wheel 54 and turns therewith. The draw chain 38 is engaged on the eccentric cam 58. It will be apparent that, as a user sitting on the seat 48 forces the ankle bar 42 away and upwardly from him, the first sprocketed wheel 50 will turn, pulling the drive chain 52, thereby turning the second sprocketed wheel 54 and associated eccentric cam 58 to pull the draw chain 38. The draw chain 38 pulls the stack chains 32, which in turn tend to lift any weights 22 engaged with the lift rods 30 of the weight stacks 18, 20. The shape of the eccentric cam 58 may be selected to be such that the moment arm from the point of rotation of the eccentric cam to the draw chain 38 is either longer or shorter so as to require the exertion of a varied, preselected amount of force on the ankle bar 42 by the user of the exercise device 10 in order to lift the weights 22.

The exercising device 10 is further provided with a weight adding means for lifting a selected number of the eccentric weights without substantial exertion of the user of the exercising device, and, at a selected point in an exercising stroke, automatically adding the force of the weight of the eccentric weights so lifted to that of any concentric weights lifted by the user in the contraction portion of the stroke. The weight adding means may include electric motors and relays or equivalent equipment activated by the position or movement of some part of the force responsive means and adapted to raise eccentric weights to leave them suspended from the stack chain 32 of the eccentric weight stack 20 at a selected point in the stroke. However, it is preferred that the exercising device 10 be provided with a pneumatic system including a source of compressed air (not shown), an air cylinder 60, a three-way valve 62, a turn-off valve 64, and connecting air hoses 65 as described below.

The air cylinder 60 is mounted on the weight tower frame 16 directly beneath the eccentric weight stack 20. The piston shaft of the air cylinder 60 is adapted to extend upwardly through the lift rod holes 26 of the weights 22 of the eccentric weight stack 20 to contact and apply pressure to the lift rod 30 of the eccentric weight stack. Thus, when air is directed into the air cylinder 60, the eccentric weight stack lift rod 30 and any weights 22 attached thereto may be lifted without any exertion on the part of the user of the exercising device 10. Likewise, exhausting the air from the air cylinder 60 so that its piston shaft is lowered leaves any weights 22 that had been lifted thereby supported only by such force if any as may be exerted by the stack chain 32 of the eccentric weight stack 20.

The three-way valve 62 is attached to the weight tower frame 16 at a location conveniently proximate to the concentric weight stack 18. The three-way valve 62 has a first position in which it directs compressed air from the air source to the air cylinder 60 to drive the shaft of the air cylinder upwardly to lift eccentric weight stack weights 22, as is described above. The three-way valve 62 also has a second position in which it vents air from the air cylinder 60 to the atmosphere, allowing the air cylinder shaft to drop. The three-way valve 62 is adapted to automatically move to its first position when the weights 22 of the concentric weight stack 18 are in their lowered position. The three-way valve 62 is also adapted to move automatically to its second position when at least the uppermost weight 22 of the concentric weight stack 18 is in its elevated position.

Figure 5:
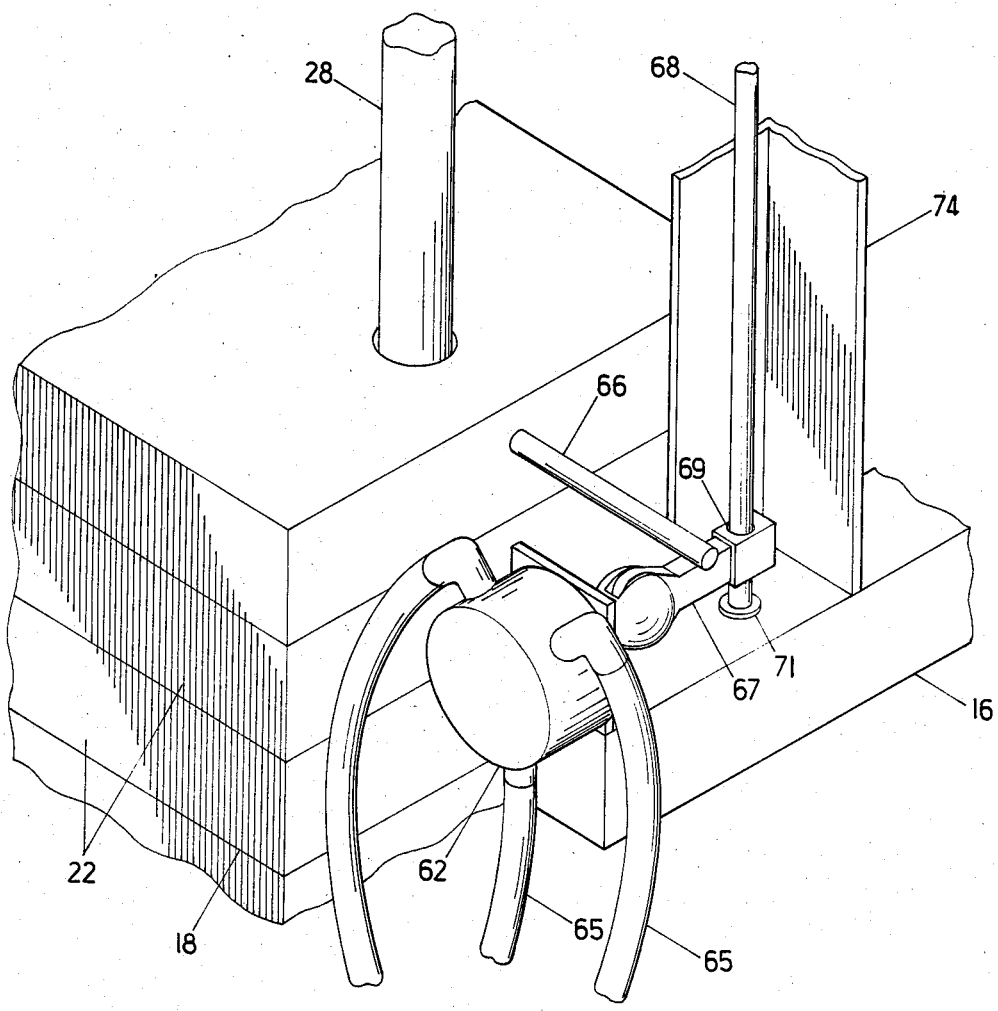
FIG. 5 is a perspective view generally from the rear of the three-way valve and related structures.

Although the three-way valve 62 may be automatically controlled electrically in the manner disclosed above in any of a number of ways apparent to one skilled in the art, mechanical means are preferred for automatically controlling the three-way valve. Preferably a trip pin 66 is attached to the uppermost weight 22 of the concentric weight stack 18, so that the trip pin assumes a lowered and elevated position as the weight moves between its corresponding positions. The trip pin 66 extends over the three-way valve 62. The three-way valve 62 has an activator lever shown in FIG. 5, that can be moved upwardly and downwardly to move the three-way valve between its first and second positions respectively. The three-way valve 62 is so located relative to the concentric weight stack 18 that the trip pin 66 contacts the activator lever 67 when the trip pin is in its lowered position to move the three-way valve to its first position. By this means, air is directed to the air cylinder 60, and the weights 22 engaged with the lift rod 30 of the eccentric weight stack 20 are so moved to their elevated position.

When the trip pin 66 is in its elevated position, it is adapted by action of an appropriate linkage to move the activator lever 67 upwardly, so as to move the three-way valve 62 to its second position. Preferably an extension rod 68 is pivotably attached to the activator lever 67 in such a way that upward movement of the extension rod lifts the activator lever while downward movement of the extension rod does not affect the position of the activator lever. Thus, the extension rod 68 may be allowed to extend through a loosely fitting hole 69 in the activator lever 67 with an end cap 71 fastened in the extension rod just below the level of the activator lever. Upward movement of the extension rod 68 so arranged brings the end cap 71 into contact with the underside of the activator lever 67 to lift it. However, the extension rod 68 may be moved downwardly, slipping through the hole 69 without moving the activator lever 67. Alternative arrangements will be apparent to those skilled in the art and are included within the scope and spirit of the invention.

The extension rod 68 extends upwardly from the activator lever 67 to be rotatably supported by the weight tower frame 16. The extension rod 68 may be turned about its longitudinal axis. Preferably a crank 70 is attached to the extension rod 68 at a convenient location to facilitate the rotation thereof. A selected portion of the extension rod 68 is threaded, and a trip member 72 is threadedly engaged thereon. The trip member 72 is so confined that it does not rotate with the extension rod 68. As a consequence, when the crank 70 is turned to rotate the extension rod 68, the trip member 72 moves upwardly or downwardly on the threads of the extension rod. In the preferred embodiment, the weight tower frame 16 includes a length of angle iron 74, the inner angle of which is presented toward the extension rod 68. The trip member 72 is confined within the inner angle of the angle iron 74, which arrangement prevents it from turning with the extension rod 68.

The trip member 72 is adapted to be engaged from beneath by the trip pin 66 as the trip pin approaches a desired elevated position, whereupon the activator lever 67 is moved upwardly, and the three-way valve 62 is thereby moved to its second position. By moving the trip member 72 upwardly or downwardly by rotating the extension rod 68 in the manner disclosed above, a user of the exercising device 10 may adjust the exact elevated position that must be assumed by the trip pin 66 to move the activator lever 67 of the three-way valve 62. If desired, the trip member 72 may be withdrawn above the uppermost possible elevated position of the trip pin 66 so that the three-way valve 62 is left indefinitely in its first position.

The turn-off valve 64 is conveniently located, preferably within reach of a user occupying the exercise station 14. The turn-off valve 64 is adapted to move between a first position, in which it supplies compressed air from the source thereof to the three-way valve 62, and a second position, in which the source of compressed air is isolated from the three-way valve and compressed air previously directed to the three-way valve is exhausted to the atmosphere.

With the trip member 72 set at a position such that the trip pin 66 contacts the trip member at a selected elevated position, a user of the exercise device 10 may move the weights 22 of the concentric and eccentric weight stacks 18, 20 through a stroke in the following manner. First, the turn-off valve 64 is moved to its first position, to direct compressed air to the three-way valve 62. The trip pin 66 will be in its lowered, at rest position. Consequently, the three-way valve 62 will be in its first position so that air is directed to the air cylinder 60. This causes any weights 22 of the eccentric weight stack 20 that are engaged with the lift rod 30 thereof to be moved to their elevated positions. The user may then exert himself against the force responsive means to perform the contraction portion of the stroke. In the embodiment of the invention described above, the user would position himself in the seat 48, hook his ankles under the ankle bar 42, and extend his legs, moving the ankle bar upwardly. By that action, by mechanisms fully disclosed above, the stack chains 32 will be so drawn as to tend to raise the lift rods 30 attached to them. The lift rod 30 of the eccentric weight stack 20 has already been lifted by the air cylinder 60, leaving the stack chain 32 attached thereto slack. However, the lift rod 30 of the concentric weight stack 18 must be lifted by action of the user's legs.

The contraction portion of the stroke is completed when the uppermost weight of the concentric weight stack 18 has been moved to a position sufficiently elevated that the trip pin 66 contacts the trip member 72, moving the extension rod and attached activator lever 67 so as to move the three-way valve 62 to its second position. The location of the trip member 72 is adjusted so that the trip pin 66 so contacts the trip member at that point at which any slack present in the stack chain 32 of the eccentric weight stack 20 has been taken up by means of movement of the draw chain 38. This, movement of the three-way valve to its second position releases the compressed air from the air cylinder 60, leaving those weights 22 of the eccentric weight stack 20 that are engaged with the lift rod 30 thereof supported only by the stack chain 32 of the eccentric weight stack. The additional force thus applied to the draw chain 38 and back through the pulleys, eccentric cam, sprocketed wheels, and drive chain all described above, eventually is translated into additional force exerted by the ankle bar 42 against the ankles of the user. Thus, as the user performs the relaxation portion of the stroke, lowering his legs, the user's muscles must exert themselves against an increased force.

As is referred to above, a releasable attachment means is provided for releasably attaching the weights 22 to the lift rod 30 associated therewith. Various releasable attachment means are known to those skilled in the art and are represented in the patents referred to above. The preferred embodiment of the releasable attachment means, as shown in the figures, includes the following structures. Each weight 22 has a side 76 aligned with corresponding sides 76 of the other weights composing the weight stack 18, 20 of which the weight is a part. The weight sides 76 conveniently may face toward the exercise station 14, as is shown in the figures. A lock pin hole 78 extends from the weight side 76 to the lift rod hole 26, preferably at an angle of or about 90° thereto. A lock pin 80 is adapted to slide freely within the lock pin hole 78. A retention member 82 is fastened to that end of the lock pin 80 which is remote from the lift rod hole 26, the retention member 82 also being attached to the weight 22. The points of attachment of the retention member 82 are provided with an amount of play sufficient to allow the lock pin 80 to move freely to a selected extent in and out of the lock pin hole 78, so that the lock pin may move between a locking position, in which a portion of the lock pin extends within the lift rod hole 26, and an unlocked position, in which the lock pin 80 is entirely withdrawn from the lock pin hole. A return spring 84 is adapted to urge the lock pin 80 toward its unlocked position.

Lock pin adjustment means are provided for selectively moving the lock pin 80 between its locking position and its unlocked position. The lock pin adjustment means includes a cam follower of a selected design. Preferably the cam follower is a rolling follower such as the pin insert wheel shown at 86. The pin insert wheel 86 is rotatably attached to the retention member 82, with the pin insert wheel adapted to rotate about an axis oriented at a right angle both to the longitudinal axis of the lock pin 80 and to the direction of travel of the weight 22 as it moves between its lowered and elevated positions.

A stepped cam 88 is associated with each of the weight stacks 18, 20 and extends generally vertically parallel thereto, facing the weight sides 26 of the weights 22 comprising the weight stack. The stepped cam 88 is supported by the weight tower frame 16 in sliding relation such that the stepped cam is free to move endwise in an up and down direction. The up and down movement of the stepped cam 88 is preferably controlled by means of weight control levers 90, the movement of which is converted into the up and down movement of the stepped cam by means of a conventional mechanical linkage such as that shown at 89. The weight control levers 90 are placed within convenient reach of a user located at the exercise station 14. The weight control levers 90 may be maintained in a given position by detents 91.

Figure 4:
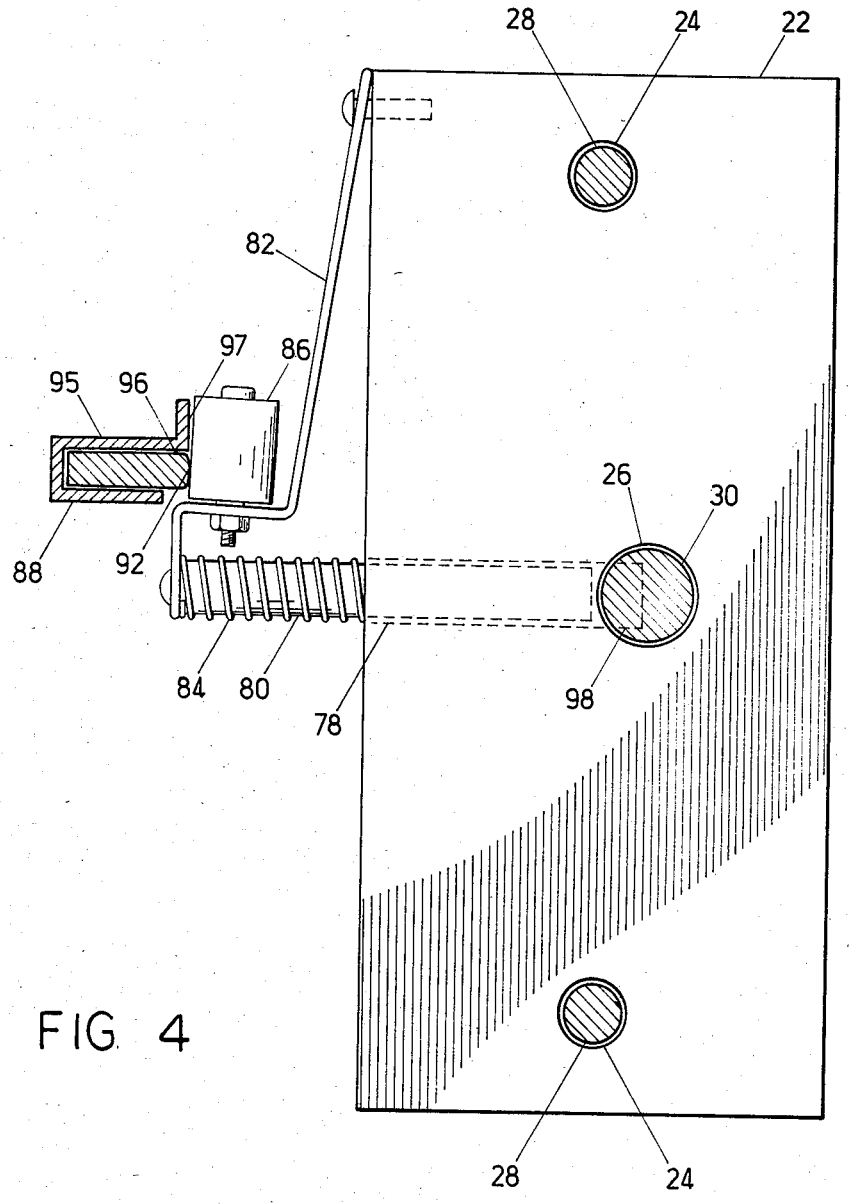
FIG. 4 is a top plan view of a weight typical of the weights used in the concentric and the eccentric weight stacks of the exercise device of FIG. 1.

The stepped cam 88 has a cam surface 92 presented toward the weight sides 26 of the weights 22 of the associated weight stack 18, 20, with the pin insert wheels 86 in rolling contact therewith. The cam surface 92 has an upper portion 94 located at a distance from the weights 22 of the associated weight stack 18, 20 such that a pin insert wheel 86 in contract therewith moves the associated retention member 82 toward the weight side 76 for a distance sufficient to move the lock pin 80 attached to the retention member to its locking position. Each lift rod 30 has a multiplicity of lock holes 98, shown in phantom in FIG. 4, adapted to receive that portion of the lock pin 80 that extends into the lift rod hole 26 when the lock pin is in its locking position. As a consequence, with the lock pin 80 in its locking position, the weight 22 may be securely locked to the lift rod 30.

The cam surface 92 also has a lower portion 96 located at a distance from the weights 22 such that a pin insert wheel 86 comes into contact therewith only when the return spring 84 has so moved the retention member 82 that the lock pin 80 is in its unlocked position.

It will be appreciated that a user located at the exercise station may move the weight control levers 90 and thereby move the stepped cams 88 vertically. By this means, the upper portion 94 of the cam surface 92 may be brought into contact, starting from the top of the weight stack 18, 20, with as many of the pin insert wheels 86 as is desired. Preferably each stepped cam 88 is supported by and slides vertically within a cam support member 95. The cam support member 95 is rigidly attached to the frame 16 and is open toward the associated weight stack 18, 20. The cam support member 95 has a retention surface 97 that lies beside and parallel to the upper portion of the cam surface 92 beginning at a point above the position of the uppermost pin insert wheel 86 when the weights 22 are in their lowered positions. The pin insert wheels 86 are broad enough to travel on both the retention surface 97 and the cam surface 92. Consequently, pin insert wheels 86 lifted with their weights 22 above a certain point are forced to retain their associated lock pins 80 in their locked positions, even when the wheels 86 travel beyond the uppermost extension of the cam surface 92. By this means, the length of the stepped cam 88 may be conveniently short. Alternatively, the upper portion 94 of the cam surface 92 may extend upwardly sufficiently far that a pin insert wheel 86 remains in contact with it continuously as the associated weight 22 moves between its lowered and elevated positions. Thus, once a weight 22 has been locked to a lift rod 30 by use of the weight pin adjustment means disclosed, it remains so locked as a user performs both the contraction and relaxation portions of an exercise stroke.

It will be apparent from the disclosure above, that the exercising device 10 of the invention is adapted to allow a user located at the exercise station 14 to cause as many weights 22 to be engaged with their associated lift rods 30 as desired and to change that number of weights, all without any need for leaving the weight station. Thus, pyramiding exercise routines may be conveniently performed by the user without leaving the exercise station or requiring the services of an assistant. Likewise, eccentric weight may be added to concentric weight at a selected point in the exercise stroke, again without resort to an assistant. All this may be done without the need for direct access to the side or back parts of the exercise device, so that the exercise device may be placed against a wall or in otherwise confined space, thus reducing the amount of floor space necessary to the use of the machine. The number of weights to be lifted may be selected from a location remote from the weights themselves by means that require no person to be exposed to the greater portion of the moving parts of the exercising device. Although alternative embodiments of the exercise device 10 of the invention could employ electrical motors, switches, or the like, as part of the releasable attachment means, for example, the preferred embodiment of the invention provides all of the invention's advantages without any such resort to electrical or electrically controlled elements.

Although the force responsive means 14 shown in the embodiment disclosed in detail above is adapted for the exercise of certain muscles of the leg, it will be apparent that any force responsive means adapted to convert the motion of a lever, handle, or other structure adapted to be moved by a user in the contraction portion of a stroke into a force tending to pull the draw chain 38 downwardly may be substituted therefor. All such alternative embodiments are within the scope and spirit of the invention.

It is understood that the invention is not confined to the particular construction and arrangement of parts herein illustrated and described. Indeed various changes may be made without departing from the spirit of the invention. Instead, the invention embraces all such modified forms thereof as come within the scope of the following claims.

What is claimed is:

1. An exercise device for the exercise of a user's muscles by movement through an exercise stroke comprising:

(a) a weight tower frame and concentric and eccentric weight stacks supported thereby, each of the weight stacks having a selected number of weights stacked in a generally vertical array, the weights being movable between lowered and elevated positions;

(b) means for selecting weights of the concentric weight stack for movement by the user;

(c) force responsive means for responding to force applied by the exercise of the user's muscles by the lifting of the selected weights of the concentric weight stack from the lowered to the elevated position;

(d) weight adding means for lifting from the lowered to the elevated position a selected number of the weights of the eccentric weight stack without additional exertion of the user; and (e) tripping means activatable by the force responsive means at a selected point in the exercise stroke for causing the weight adding means automatically to add the weight of the weights so lifted by the weight adding means to that of the weights of the concentric weight stack lifted by the force applied by exercise of the user's muscles.

2. The exercising device of claim 1 wherein the force responsive means includes stack chains attached to each of the weight stacks and a draw chain, the draw chain being coupled to the stack chains at a common point remote from the point of attachment of the stack chains to their respective weight stacks; the force responsive means further including a mechanical linkage adapted to translate the force applied by the exercise of the user's muscles into movement of the draw chain so as to tend to draw the stack chains upward.

3. The exercising device of claim 2 wherein the weight adding means includes an air cylinder and a three-way valve adapted to move between a first position, in which compressed air is directed through the three-way valve to charge the air cylinder, and a second position, in which compressed air from the air cylinder is vented to the atmosphere, the air cylinder being adapted when charged with compressed air to lift from the lowered to the elevated position a selected number of the weights of the eccentric weight stack, the three-way valve being adapted to assume its first position when a selected one of the weights of the concentric weight stack is in its lowered position and to assume its second position when that selected weight is in its elevated position.

4. The exercising device of claim 3 wherein the three-way valve includes an activator lever that may be moved downwardly and upwardly to move the three-way valve between its first and second positions respectively, an extension rod is attached to the activator lever and extends upwardly therefrom, and a trip member is attached to the extension rod at a selected distance above the activator lever, the extension rod and trip member being adapted to shift upwardly and thus to move the activator lever upwardly; and wherein the concentric weight stack includes an uppermost weight, the uppermost weight having a trip pin attached thereto that extends over the activator lever of the three-way valve, the trip pin, when the uppermost weight is in its lowered position, being adapted to push the activator lever downwardly to move the three-way valve to its first position and, when the uppermost weight is in its elevated position, to push the trip member upwardly, causing the attached extension rod and activator lever likewise to move upwardly to move the three-way valve to its second position, whereby, when the uppermost weight of the concentric weight stack is in its lowered position, the air cylinder may be charged with compressed air to lift the selected number of weights of the eccentric weight stack to their elevated position and, when the uppermost weight of the concentric weight stack is raised to its elevated position, the compressed air charging the air cylinder may be vented therefrom, allowing the air cylinder to withdraw, leaving the weights of the eccentric weight stack raised by the air cylinder suspended from the stack chain associated therewith and thus adding their weight to that of the weights of the concentric weight stack lifted by the force applied by the exercise of the user's muscles.

5. The exercising device of claim 4 wherein the extension rod is pivotably attached to the activator lever, a selected portion of the extension rod is threaded, and the trip member is threadedly engaged thereon, the trip member being so constrained that it may not rotate around the longitudinal axis of the extension rod, whereby the extension rod may be rotated about its longitudinal axis to cause the trip member to move upwardly and downwardly on the threaded portion of the extension rod to adjust the degree of elevation to which the uppermost weight of the concentric weight stack must be raised before the trip pin engages the trip member to cause the three-way valve to move to its second position.

6. The exercising device of claim 1 wherein at least one of the eccentric and concentric weights stacks includes a multiplicity of weights, each weight having a lift rod hole, all of the lift rod holes being vertically aligned with each other, and including a lift rod attached to the stack chain associated with the stack of weights and adapted to extend downwardly through the aligned lift rod holes, and further including releasable attachment means for releasably attaching the weights to the lift rod.

7. The exercising device of claim 6 wherein each weight has a weight side and a lock pin hole extending from the weight side to the lift rod hole; and including a lock pin adapted to move freely in and out of the lock pin hole between a locking position, in which a portion of the lock pin extends within the lift rod hole, and an unlocked position, in which the lock pin is withdrawn from the lift rod hole, a return spring adapted to urge the lock pin toward its unlocked position, retention means for retaining the lock pin generally within the lock pin hole, and lock pin adjustment means for selectively moving the lock pin between its locking position and its unlocked position; and wherein the lift rod has a selected number of lock holes adapted to receive that portion of the lock pin that extends into the lift rod hole when the lock pin is in its locking position, whereby the user of the exercising device may select and vary the number of weights to be lifted by the lift rod by use of the lock pin adjustment means.

8. The exercising device of claim 7 wherein the lock pin adjustment means includes a stepped cam adapted to move up and down and having a cam surface including an upper and lower portion, and a cam follower biased against the cam surface and adapted to move with the lock pin, the upper portion of the cam surface being so located that a cam follower biased thereagainst moves the lock pin to its locking position to secure the weight to the lift rod, and the lower portion of the cam surface being so located that a cam follower biased thereagainst moves the lock pin to its unlocked position; the exercise device further including means for adjusting the vertical location of the stepped cam, whereby the user may selectively engage and disengage weights from the lift rod by moving the stepped cam vertically to a desired location.

9. The exercising device of claim 8 wherein the means for adjusting the vertical location of the stepped cam includes a control lever conveniently manipulatable by the user when the user is located at the exercise station and a mechanical linkage converting movement of the weight control levers into vertical movement of the stepped cam.

* * * * *